US005408743A

United States Patent [19]

Tournier et al.

[11] Patent Number: 5,408,743

[45] Date of Patent: Apr. 25, 1995

[54] PROCESS FOR CONNECTING AN ELECTRIC CABLE HAVING A LIGHT METAL CORE TO A STANDARDIZED END ELEMENT

[75] Inventors: Gilles Tournier, Leguevin; Jean-Luc Ballenghien; Serge Roques, both of Bugnac, all of France

[73] Assignee: Aerospatiale Societe Nationale Industrielle, Paris Cedex, France

[21] Appl. No.: 119,135

[22] PCT Filed: Jan. 20, 1993

[86] PCT No.: PCT/FR93/00055

§ 371 Date: Sep. 20, 1993

§ 102(e) Date: Sep. 20, 1993

[87] PCT Pub. No.: WO93/14535

PCT Pub. Date: Jul. 22, 1993

[30] Foreign Application Priority Data

Jan. 21, 1992 [FR] France ..... 92 00589

[51] Int. Cl.[6] ..... H01R 4/18

[52] U.S. Cl. ..... 29/863; 439/877; 439/879

[58] Field of Search ..... 439/865-868, 439/877-882; 174/84 C; 29/863-867

[56] References Cited

U.S. PATENT DOCUMENTS

| | | | |
|---|---|---|---|
| 2,982,808 | 5/1961 | Schwester | 439/877 |
| 3,184,535 | 5/1965 | Worthington | 439/877 |
| 3,844,923 | 10/1974 | Sandrock | 439/865 |

FOREIGN PATENT DOCUMENTS

| | | |
|---|---|---|
| 0018863 | 11/1980 | European Pat. Off. . |
| 1099263 | 9/1955 | France . |
| 1233649 | 10/1964 | France . |
| 977466 | 12/1964 | United Kingdom . |

*Primary Examiner*—Gary F. Paumen
*Attorney, Agent, or Firm*—Michael N. Meller

[57] ABSTRACT

In order to connect an electric cable (12) having a light metal core (14) to a standardized end element such as a connector contact, the partly bare end of the cable is introduced into a blind hole (20) formed in a connecting part (10) made from an electrically conductive, cold deformable material. More specifically, the bare cable end is introduced into a truncated cone-shaped, intermediate portion (24) and into a bottom portion (22) of the hole (20), whilst the adjacent end of the cable sleeve (16) is introduced into a larger diameter, inlet portion (26) of the hole. In view of the fact that the part (10) has a truncated cone-shaped, outer surface around the blind hole, a radial compacting of the part has the effect of embedding the cable end in said part and mechanically joining the latter both to the core and to the sleeve of the cable.

18 Claims, 3 Drawing Sheets

PROCESS FOR CONNECTING AN ELECTRIC CABLE HAVING A LIGHT METAL CORE TO A STANDARDIZED END ELEMENT

BACKGROUND

The invention relates to a process making it possible to connect an electric cable having a core made from a light metal such as aluminium and covered with an insulating sleeve, to a standardized end element such as a connector contact. The invention also relates to a connecting part usable in performing this process.

The invention is applicable to all industries using long electric cable lengths and for which cost and weight savings are desired. One of these industries is the aeronautical industry.

In the manufacture of aircraft, certain large section, copper core cables more particularly equipping the main electric power supply circuits have been replaced over the past few years by aluminium core cables. Despite the need of using larger section aluminium core cables in order to compensate a reduced conductivity compared with copper, the mass or weight balance reveals a gain of approximately 50%.

In order to take further advantage of the weight gain resulting from the use of aluminium core cables, it would also be logical to replace smaller section copper core cables by aluminium core cables. This replacement is more particularly envisaged for cables ranging from gauge 10 (section 4.9 $mm^2$) to gauge 24 (section 0.2 $mm^2$).

However, although the ultimate tensile strength difference between the two materials causes no particular problems in the case of cables having a cross-section exceeding 5 $mm^2$, it becomes critical for cables with a smaller cross-section. Thus, the stresses exerted on the cable, particularly during the construction of cable systems, may then be prejudicial to the electrical continuity of the circuits and therefore to the safety of aircraft.

In the case of smaller size cables from gauge 10 to gauge 24, to obtain a mechanical strength for the connections produced with aluminium core cables substantially equivalent to that obtained with copper core cables it becomes necessary for the insulating sleeve of the cable, which is made from plastic materials having high mechanical and electrical performance characteristics, to participate in the strength of the connection.

Moreover, unlike copper core cables, the sensitivity of aluminium core cable to chemical attack, requires the connection between the aluminium cable and the copper contact to be made tight, in order to insulate the aluminium from the ambient medium.

However, in view of the larger diameter needed for the aluminium core cable compared with the copper core cable, any diameter increase to the contacts for ensuring the sealing and the tensile strength of the connection makes it difficult or even impossible to use standardized tools for the fitting and unlocking of the contacts, if use is made of the most widely employed standardized connectors with unlocking of the contacts from the rear.

In addition, an increase to the diameter of the cavities formed on the standardized connectors for receiving the standardized contacts is difficult to envisage without modifying the location of the cavities, as a result of their proximity on existing connectors. However, a modification to the positions of the cavities would make obsolete all the presently used standardized connectors.

Finally, a change to the connection technology for using contacts with unlocking from the front would require significant modifications and the creation of new connectors, which is obviously undesirable.

SUMMARY OF THE INVENTION

The present invention relates to a process to connect an electric cable having a core made from a light metal, such as aluminium, to a standardized end element such as an electric contact, whilst ensuring a stable and reliable electrical connection. The connection provides additional mechanical strength on the insulating sleeve and a sealing with respect to the external ambient without making the standardized connection system obsolete and whilst preserving to the maximum the use of existing tools.

The process of the present invention for the connection of an electric cable having a light metal core covered with an insulating sleeve to a standardized end element, is characterized by the following stages:

an at least partial introduction of the bare terminal portion of the cable into a bottom portion of a blind hole formed in a connecting part made from an electrically conductive, deformable material, and an adjacent, non-bare portion of the cable into an inlet portion of the blind hole having a larger diameter than the bottom portion, with the connecting part having a thickness increasing at least partly around the bottom portion and around the inlet portion of the blind hole toward its open end, radial compacting of the connecting part to give it, round the inlet portion of the blind hole, a first external diameter substantially equal to the initial external diameter of the cable sleeve and, over the remainder of its length, a second external diameter substantially equal to the initial external diameter of the cable core.

Under the effect of the compacting the diameter variations initially present on the exterior of the connecting part are transferred to the interior of the blind hole. Therefore a mechanical link is made both between the connecting part and the light metal core of the cable and between the connecting part and the insulating sleeve of the cable. Moreover, the sealing of the connection between the standardized end element and the cable is ensured.

Compacting also makes it possible to introduce the end of the cable to which has been fixed the connecting part into the standardized end element and to crimp said end in said element, as if the electric cable had been directly fitted in a standardized end element.

As a variant, the connecting part can be directly formed by the end element, so that no subsequent crimping is necessary.

Preferably, use is made of a connecting part having at least one truncated cone-shaped external surface around the bottom portion and around the inlet portion of the blind hole. In this case, use is advantageously made of a connecting part having, between the bottom portion and the inlet portion of the blind hole, a constant thickness, truncated cone-shaped, tubular portion, the outer truncated cone-shaped surface forming a single truncated cone-shaped surface with the outer surface of the truncated cone-shaped, tubular portion.

When the cable core is formed from wires assembled in strand form and defining between them inter-wire spaces, use is preferably made of a connecting part, whose truncated cone-shaped, tubular portion has a section substantially equal to that of said inter-wire spaces.

Although the radial compacting of the connecting part can be carried out in different ways, it is advantageously performed by the force passage through a calibrated tool. For this purpose, a tension can be exerted on a rod-shaped portion formed beyond the blind hole in the connecting part. This rod-shaped portion is then cut prior to the connecting part being introduced and crimped in the end element.

The invention also relates to a connecting part for fitting by radial compacting to the partly bare end of an electric cable having a light metal core, covered with an insulating sleeve, in order to permit a connection of said cable to a standardized end element, characterized in that said part is made from an electrically conductive, deformable material, has a symmetry of revolution about a longitudinal axis, has along said axis a staged blind hole having a bottom portion and an inlet portion with a larger diameter than the bottom portion and a thickness which at least partly increases around the bottom portion and around the inlet portion of the blind hole, passing towards an open end of the latter.

BRIEF DESCRIPTION OF THE DRAWINGS

The invention is described in greater detail hereinafter relative to a non-limitative embodiment and with reference to the attached drawings, FIG. 1 a part longitudinal sectional view of a connecting part for fitting to the end of an electric cable having a light metal core, in order to permit the connection of said cable to a standardized end element.

DETAILED DESCRIPTION OF THE PREFERRED EMBODIMENT

Figure 1:
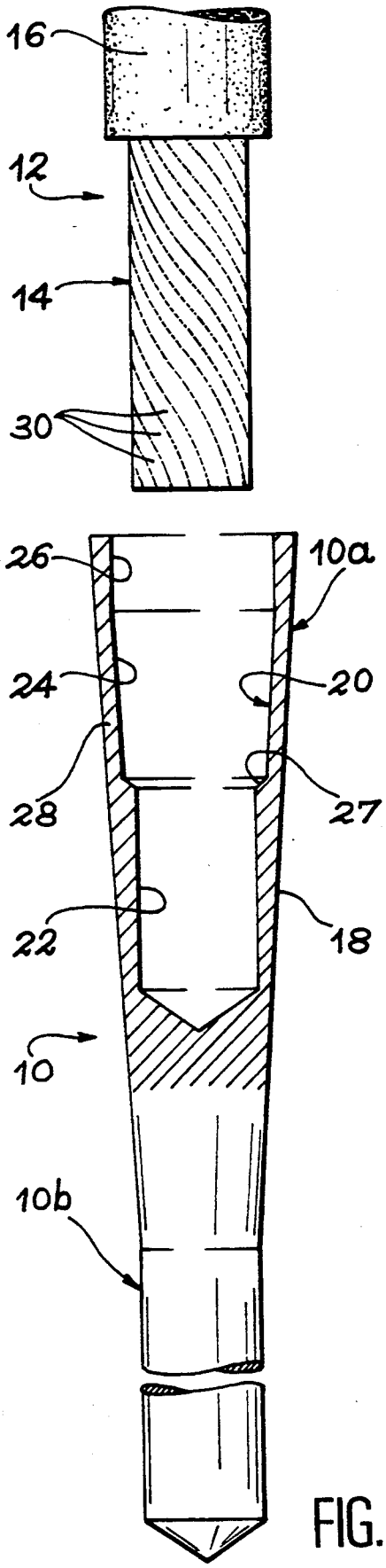

FIG. 1 shows a connecting part 10 in the state which it initially occupies prior to fitting to the end of an electric cable 12 formed by a core 14 of a light metal such as aluminium and an insulating sleeve 16 covering said core 14, with the exception of its bare end illustrated in FIG. 1.

As has already been stated, the fitting of the connecting part 10 to the end of the cable 12 is intended to permit the connection of the latter to a standardized end element such as a contact of a standardized connector. In addition, this connection must be such that it ensures a mechanical tensile link between the standardized end element and the cable core, as well as between the standardized end element and the cable sleeve. Finally, said connection must be tight, in order to protect the bare portion of the light metal core 14 from the environment.

The connecting part 10 is made from an electrically conductive material and has good cold deformation characteristics, such as annealed brass covered with a protective coating of electrically conductive, highly malleable silver or tin.

The connecting part 10 has a symmetry of revolution about a longitudinal axis and has a hollowed out portion 10*a* able to receive the partly bare end of the electric cable 12 and a solid portion 10*b*, in the form of a cylindrical rod, designed so as to permit the tension of said part through calibrated tools such as draw dies. It should be noted that if compacting is carried out by other means, the solid portion 10*b* can be eliminated.

The hollowed out portion 10*a* of the connecting part 10, which constitutes the essential portion of the latter, is turned upwards in FIG. 1. This hollowed out portion has a truncated cone-shaped, outer surface 18, whose diameter increases progressively from the solid portion 10*b* to its end. The outer surface 18 can e.g. form an angle of approximately 3° with the longitudinal axis of the connecting part 10.

A staged or stepped blind hole 20 is formed coaxially in the hollowed out portion 10*a* of the part 10, so as to be able to receive the partly bare end of the electric cable 12.

More specifically, the staged blind hole 20 has, starting from the bottom, a cylindrical bottom portion 22, a truncated cone-shaped intermediate portion 24 and a cylindrical inlet portion 26 having a larger diameter than the bottom portion 22. The truncated cone-shaped portion 24 is separated from the bottom portion 22 by a shoulder 27 and forms with the longitudinal axis of the part an angle equal to the angle formed with said same axis by the outer surface 18. In the considered example, said angle is substantially equal to 3°. Thus, the truncated cone-shaped, tubular portion 28 formed in the part 10 around the truncated cone-shaped portion 24 of the blind hole 20 has a constant thickness. The inlet portion 26 is located in the immediate extension of the truncated cone-shaped portion 24 and has a diameter equal to the largest diameter of said truncated cone-shaped portion.

Figure 2D:
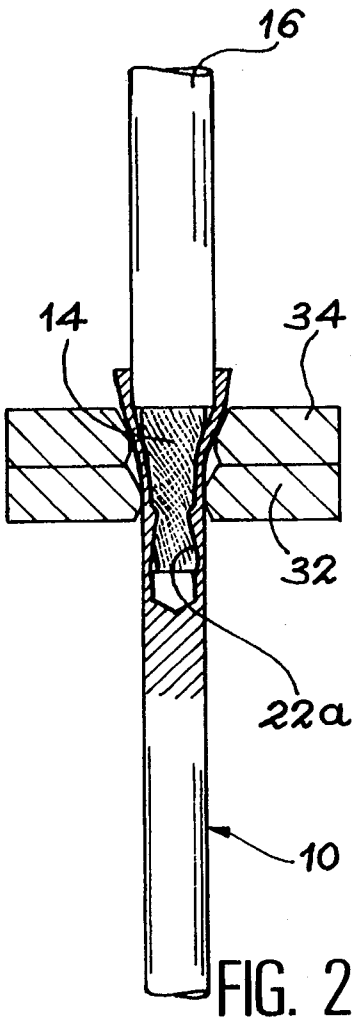
FIGS. 2A to 2I longitudinal sectional views diagrammatically illustrating different stages in the performance of the connection process according to the invention.
Figure 2C:
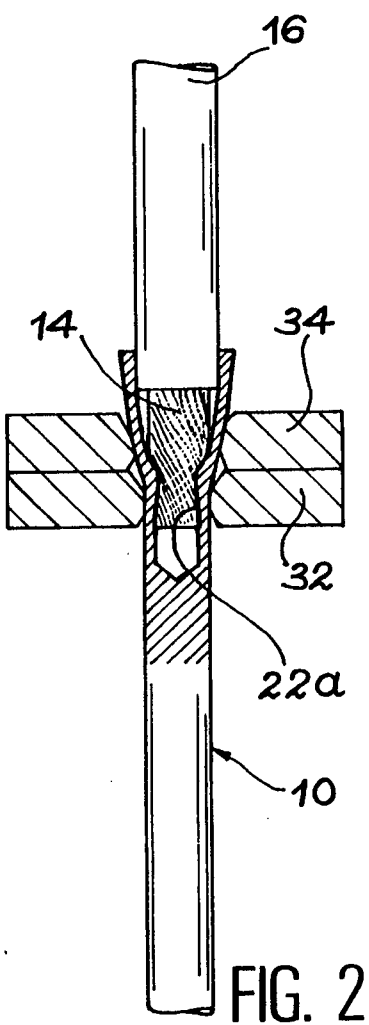
Figure 2B:
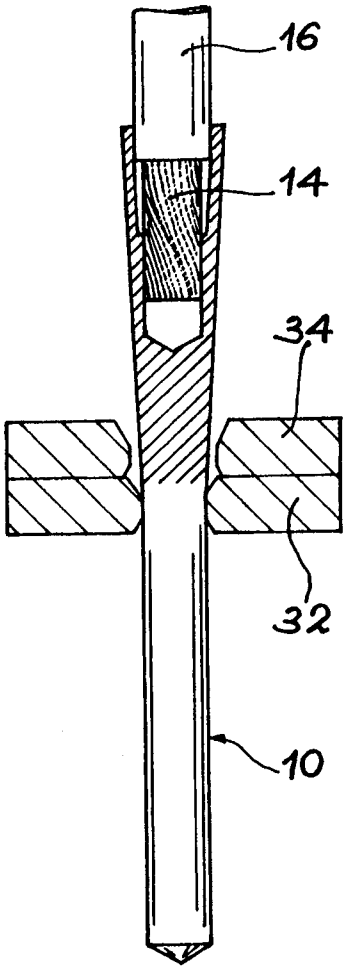
Figure 2A:
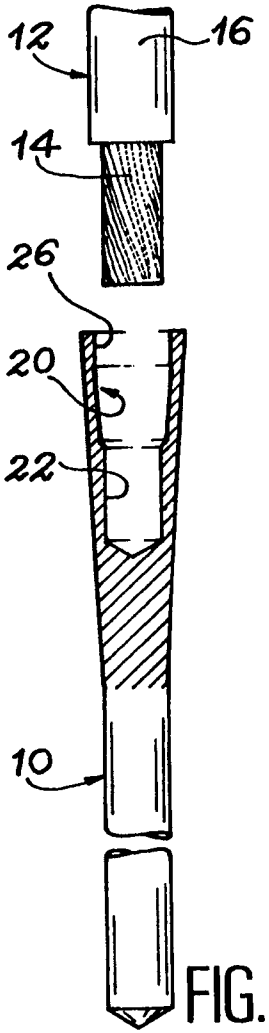

The diameter of the bottom portion 22 of the blind hole 20 is substantially equal to the external diameter of the core 14 of the electric cable 12 and the diameter of the inlet portion 26 is substantially equal to the external diameter of the insulating sleeve 16 of the cable. This feature makes it possible to engage the non-bare portion of the cable 12 adjacent to the bare terminal portion of said cable in the inlet portion 26 of the blind hole 20 and make the end of the bare terminal portion of the cable 12 penetrate the bottom portion 22 of the blind hole 20, as illustrated in FIG. 2B.

More specifically, when the non-bare portion adjacent to the bare terminal portion of the cable 12 is introduced into the inlet portion 26 of the blind hole 20, the bare terminal portion of the cable 12 traverses the truncated cone-shaped portion 24 and partly penetrates the bottom portion 22, so that its end is located at a certain distance from the bottom of the blind hole 20.

Figure 3A:
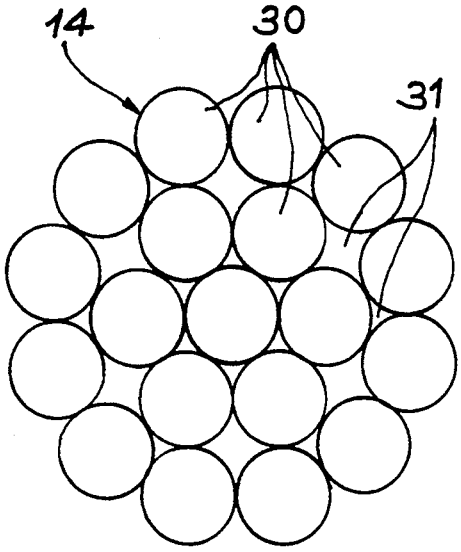
FIGS. 3A and 3B cross-sections respectively showing the core of the electric cable in its initial state and after its radial compacting.

In the embodiment more specifically illustrated in the drawings, the core 14 of the electric cable 12 is formed by a plurality of wires 30 assembled to form a strand and whose initial cross-section is illustrated in FIG. 3A. As is shown in the latter, each of the unitary wires 30 of the core 14 then has in section a circular shape and inter-wire spaces 31 exist between adjacent wires of the strand.

When the end of the electric cable 12 has been introduced into the staged blind hole 20 formed in the connecting part 10 in the manner described hereinbefore, said part is placed in a tool formed by two juxtaposed dies 32,34. More specifically, the solid, rod-like portion of the connecting part 10 is successively introduced into the dies 34,32 in such a way that the die 34 having the largest internal diameter is turned towards the hollowed out portion of the part 10. The internal diameter of the die 34 is substantially equal to the external diameter of the insulating sleeve 16 of the cable 12, whilst the internal diameter of the die 32, which has a smaller cross-section, is substantially equal to the initial external diameter of the cable core 14.

When a tension is exerted on the solid, rod-like portion of the connecting part 10, the cooperation of the smaller diameter die 32 with the truncated cone-shaped, outer surface 18 of the part 10 has the effect of progressively giving said truncated cone-shaped surface the shape of a cylinder with a diameter equal to the initial diameter of the cable core. As is successively illustrated by FIGS. 2C and 2D, this initially leads to the inverting of the cone initially formed on the outer surface 18, so as to form a cone 22*a*, whose diameter progressively decreases into the bottom portion 22 of the blind hole 20, which initially had a cylindrical shape. The inverted cone 22*a* formed in this way in the bottom portion of the blind hole 20 of the part 10 forms an effective mechanical link between the core 14 of the cable 12 and the connecting part 10. The mechanical link obtained between the core of the cable 14 and the connecting part 10 makes it possible to confine the cable during the compacting of the core and the insulated cable. As a result of this mechanical link, any tensile stress exerted on the core of the cable 14 is automatically transmitted to the connecting part 10.

Figure 3B:
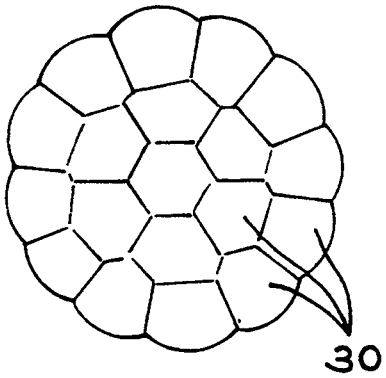
Figure 2I:
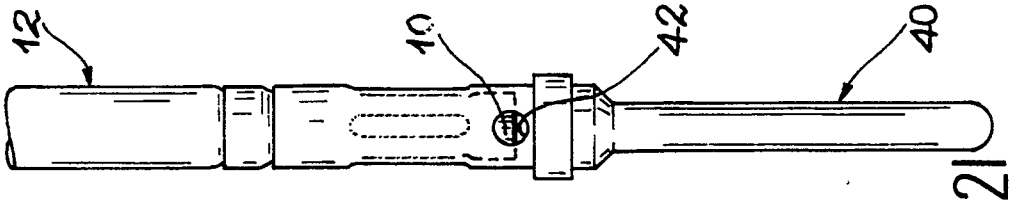
Figure 2H:
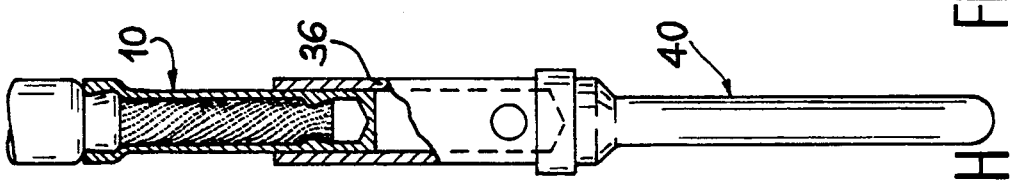
Figure 2G:
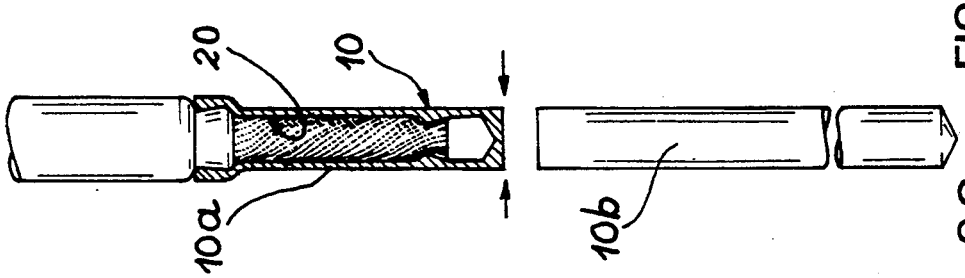

When the tension exerted on the cylindrical, rod-shaped portion of the connecting part 10 continues, the tubular, truncated cone-shaped portion 28 of the part 10 in turn passes into the die 34. Thus, to said portion of the part 10 is given the shape of a cylindrical tube 28*a* (FIGS. 2E and 2F), whose external diameter is substantially equal to the initial external diameter of the electric cable core 14 and whose internal diameter is dependent on the initial thickness of the part 10 in said zone. Said thickness is advantageously chosen in such a way that the cross-section of the truncated cone-shaped, tubular portion 28 is substantially equal to the initial section of all the inter-wire spaces 31. Thus, the radial compacting of said portion 28 of the connecting part 10 leads to a radial compacting of the electric cable core 14, which is sufficient to essentially bring about the disappearance of the inter-wire spaces 31, whilst maintaining the total section of the wires 30 of the cable core 14 at a value substantially equal to that which it had prior to compacting. FIG. 3B illustrates a cross-section of the core 14 of the cable 12 obtained in said zone after compacting had taken place.

Figure 2F:
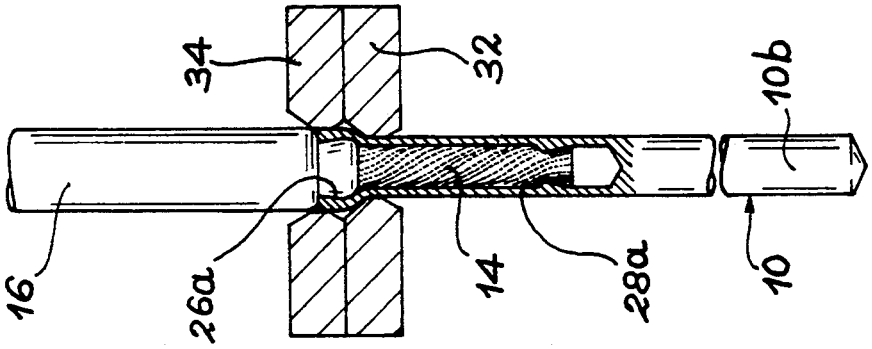
Figure 2E:
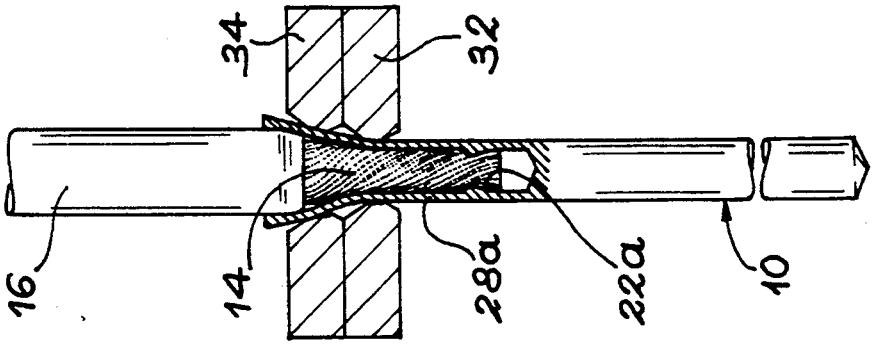

As is illustrated in FIG. 2F, the tension exerted on the solid, rod-shaped portion 10*b* of the connecting part 10 is continued until the open end of said part comes to the right of the larger diameter die 34. The smaller diameter die 32 is then located slightly beyond the end of the sleeve 16 adjacent to the bare portion of the cable.

During this final phase, the radial compacting of the connecting part 10 is continued by the die 32 around the truncated cone-shaped portion 24 of the hole 20 and by the die 34 round the cylindrical portion 26 of said hole. Under the effect of its passage into the die 34, the end of the truncated cone-shaped surface 18 initially surrounding the inlet portion 26 assumes a cylindrical shape and a diameter substantially equal to the external diameter of the sleeve 16.

Conversely, the cone initially present on the outer surface of the part 10 is inverted and transferred to the inner surface of said part, i.e. the initially cylindrical portion 26 assumes a truncated cone shape 26*a*, whose diameter progressively decreases up to the end of the part 10, as illustrated in FIG. 2F. A mechanical link is thus created between the connecting part 10 and the insulating sleeve 16. As a result of this mechanical link, any tensile stress exerted on the insulating sleeve is automatically transmitted to the connecting part 10.

When the above-described radial compacting operation is ended, the solid, rod-shaped portion of the connecting part 10 is cut slightly beyond the bottom of the blind hole 20, as illustrated in FIG. 2G. A cable 12 is then provided, whose end is embedded in a sealed tubular part 10 and tightly crimped on the end of the sleeve 16, in such a way that the bare end of the cable core 14, made from an easily oxidizable light metal, is not in direct contact with the external atmosphere.

Moreover, the crimping of said part 10 both on the sleeve 16 and on the core 14 makes it possible to ensure an effective mechanical link using both the mechanical strength of the core and that of the sleeve of the cable when a tensile stress is exerted on the latter.

In addition, the dimensions of the cable end are identical to those of a partly bare cable not embedded in the part 10, which makes it possible to envisage the connection of said cable to an end element such as a standardized contact using existing tools. It should be noted that this essential feature is obtained without the effective section of the cable being significantly reduced in the connection zone, because the radial compacting of the cable core within the part 10 is carried out in such a way that the cross-sectional shape of each of the cable wires 30 is modified (FIG. 3B) and the spaces 31 initially present between these wires are substantially eliminated, without any real modification to the section of each of the strands.

Finally, the compacting of the cable core 14, bearing in mind the constituent and protective materials of the part 10, makes it possible to obtain freedom from differential expansion stresses.

FIG. 2H illustrates the introduction of the end of a cable 12, embedded according to the invention in a part 10, into the interior of the file portion 36 of a standardized contact 40. When the said end has been totally introduced into the female portion 36, the end of the part 10 appears in front of an insertion control hole 42 traversing the female portion 36. Standardized crimping pliers can then be used in conventional manner to crimp the female portion 36 of the contact 40 on the part 10, as illustrated in FIG. 2I.

Obviously, the invention is not limited to the embodiment described in exemplified manner hereinbefore and covers all variants thereof. Thus, the connection process according to the invention can be used for standardized end elements different from the contacts 40 of connectors illustrated in FIGS. 2H and 2I. These standardized end elements can in particular be formed by lugs of different types, relay base or socket contacts, strip module contacts, earth module contacts, etc.

Moreover, the radial compacting obtained in the embodiment represented by the force passage through calibrated tools such as draw dies can be replaced by all equivalent processes, such as ball or roller rolling processes, magnetoforming methods, or compacting methods in tools having mobile jaws. Consequently, the solid, rod-shaped portion 10*b* of the part 10 can, in certain cases, be eliminated. The stage of cutting said part then disappears.

It is also possible to use the connecting process according to the invention for the direct fixing of the standardized end element to the end of the cable. In this case, shapes comparable to those described for the hollowed out portion 10*a* of the part 10 are provided directly on the end element to which the cable has to be fixed.

Finally, it will be clear that the shapes defined hereinbefore for the hollowed out portion of the part 10 must not be considered as limitative. In particular, all variations of thicknesses initially possessed by the part 10 to the right of the bare cable core and the sleeve end adjacent to said bare core makes it possible to obtain the sealing and mechanical link required, when a radial compacting of the part is carried out.

We claim:

1. Process for connecting an electric cable (12), having a light metal core (14) covered with an insulating sleeve (16), to a standardized end element (40), comprising the steps of:

at least partially introducing the bare terminal portion of the cable into a bottom portion (22) of a blind hole (20) formed in a connecting part (10) made from an electrically conductive, deformable material, and an adjacent, non-bare portion of the cable into an inlet portion (26) of the blind hole (20) having a larger diameter than the bottom portion, with the connecting part having an increased wall thickness at least partly around the bottom portion and at least partly around the inlet portion of the blind hole and radially compacting the connecting part (10) to give it, round the inlet portion of the blind hole (20), a first external diameter substantially equal to the initial external diameter of the cable sleeve and, over the remainder of its length, a second external diameter substantially equal to the initial external diameter of the cable core.

2. Process according to claim 1, characterized in that use is made of the connecting part (10) having at least one truncated cone-shaped, outer surface (18) around the bottom portion (22) and around the inlet portion (24) of the blind hole (20).

3. Process according to claim 2, characterized in that use is made of the connecting part having a tubular, truncated cone-shaped portion (28) with a constant wall thickness between the bottom portion and the inlet portion of the blind hole, said truncated cone-shaped outer surface (18) being extended on said tubular portion.

4. Process according to claim 3 applied to the connection of a cable (12), whose core (14) is formed from wires (30) assembled in strand form and defining between them inter-wire spaces (31), characterized in that use is made of a connecting part, whose truncated cone-shaped, tubular portion has a cross-section substantially equal to that of said inter-wire spaces (31).

5. Process according to claim 1, characterized in that the radial compacting of the connecting part (10) is carried out by passage through a calibrated tool (32,34).

6. Process according to claim 5, characterized in that the force passage is carried out by exerting a tension on a rod-shaped portion formed beyond the blind hole (20) in the connecting part.

7. Process according to claim 6, characterized in that after the radial compacting of the connecting part (10), the rod-shaped portion is separated therefrom.

8. Process according to claim 5, characterized in that the connecting part (10) is then introduced into the end element (40), followed by the crimping of the latter onto the connecting part.

9. Process according to claim 1, characterized in that the end element (40) is directly used as the connecting part.

10. Process according to claim 2, characterized in that the radial compacting of the connecting part (10) is carried out by passage through a calibrated tool (32,34).

11. Process according to claim 3, characterized in that the radial compacting of the connecting part (10) is carried out by passage through a calibrated tool (32,34).

12. Process according to claim 4, characterized in that the radial compacting of the connecting part (10) is carried out by passage through a calibrated tool (32,34).

13. Process according to claim 6, characterized in that the connecting part (10) is then introduced into the end element (40), followed by the crimping of the latter onto the connecting part.

14. Process according to claim 7, characterized in that the connecting part (10) is then introduced into the end element (40), followed by the crimping of the latter onto the connecting part.

15. Process according to claim 2, characterized in that the end element (40) is directly used as the connecting part.

16. Process according to claim 3, characterized in that the end element (40) is directly used as the connecting part.

17. Process according to claim 4, characterized in that the end element (40) is directly used as the connecting part.

18. Process according to claim 5, characterized in that the end element (40) is directly used as the connecting part.

* * * * *